US006445899B2

(12) United States Patent
Sato

(10) Patent No.: US 6,445,899 B2
(45) Date of Patent: Sep. 3, 2002

(54) TANDEM COLOR IMAGE FORMING DEVICE CAPABLE OF FORMING HIGH-QUALITY COLOR IMAGES

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/728,081

(22) Filed: Dec. 4, 2000

(30) Foreign Application Priority Data

Dec. 6, 1999 (JP) ..... 11-345773
Jun. 14, 2000 (JP) ..... 2000-178514

(51) Int. Cl.[7] ..... G03G 15/08; G03G 15/01
(52) U.S. Cl. ..... 399/284; 399/299
(58) Field of Search ..... 399/71, 101, 148, 399/149, 222, 265, 279, 284, 286, 299; 430/108.7, 111

(56) References Cited

U.S. PATENT DOCUMENTS 5,287,150 A * 2/1994 Kinoshita et al. ..... 399/262
5,724,642 A * 3/1998 Cala ..... 399/364
6,029,033 A * 2/2000 Kawasaki ..... 399/284
6,104,903 A * 8/2000 Hara et al. ..... 399/265
6,215,967 B1 * 4/2001 Takeda et al. ..... 399/43
6,287,739 B1 * 9/2001 Kawakami et al. ..... 399/222

* cited by examiner

*Primary Examiner*—Arthur T. Grimley
*Assistant Examiner*—Hoang Ngo
(74) *Attorney, Agent, or Firm*—Oliff & Berridge, PLC

(57) ABSTRACT

A color image forming device capable of preventing image from being degraded due to image transfer operations. A plurality of photosensitive drums are positioned in alignment in a rotational direction of intermediate recording medium. A plurality of developing rollers are provided in confrontation with corresponding photosensitive drums. Layer thickness regulating blades are provided in contact with corresponding developing rollers so as to form a thin toner layer having a two-layer thickness on the developing rollers.

18 Claims, 3 Drawing Sheets

TANDEM COLOR IMAGE FORMING DEVICE CAPABLE OF FORMING HIGH-QUALITY COLOR IMAGES

BACKGROUND OF THE INVENTION

1. Field of the Invention

The present invention relates to a color image forming device for forming color images, wherein carrying members for carrying developing agents of various colors are juxtaposed along a moving direction of an intermediate recording medium.

2. Description of the Related Art

There is known a color laser printer including a single photosensitive drum and an intermediate drum. A toner image is formed on the photosensitive drum, and then transferred onto the intermediate drum. The same operation is repeatedly performed for each of a plurality of different colors. As a result, visible toner images of different colors are overlaid in turn, thereby forming a color image on the intermediate drum. Then, the color image Is transferred onto a paper sheet. In this type of printer, however, the time required for forming a color image, for example a four-color image, would be four times that required to form a single-color image. Hence, it is difficult to form a color image at a high rate of speed.

There is also known a tandem color laser printer using a tandem image-forming method. This type of laser printer includes a plurality of developing units juxtaposed in a juxtaposing direction, such as vertical or horizontal direction. Each of the developing units stores different color toner, that is, one of cyan toner, magenta toner, yellow toner, and black toner, and includes a developing roller, a charging unit, and an exposing unit. The developing roller is for carrying the toner. The photosensitive drum is disposed opposite the developing roller. The charging unit and the exposing unit are disposed in opposition to the photosensitive drum for forming an electrostatic latent image thereon. A visible toner image corresponding to the electrostatic latent image is developed on the photosensitive drum and directly transferred onto a paper sheet which is being transferred in the juxtaposing direction of the developing units. As a result, toner images of different colors are overlaid In turn on the paper sheet, thereby forming a color image thereon. Because the plurality of developing units perform toner image developing operations nearly simultaneously, a color image can be formed on a paper sheet at an extremely rapid rate.

However, because toner images are directly transferred from the photosensitive drums onto the paper sheet in the tandem color printer, fluctuations in the resistance value on the paper sheet can make the toner images unstable and prevent proper transfer of the toner images. More specifically, the resistance value of the paper sheet can vary due to ambient humidity, thickness of the sheet, type of sheet material, and the like. This changes the charge retaining ability of the paper sheet. As a result, satisfactory toner image transfer may not be performed. Also, toner transferred at an upstream-side developing unit may be deposited on a photosensitive drum of a downstream-side developing unit with respect to the juxtaposing direction, thereby undesirably mixing the different colors and reducing image quality.

In order to overcome the above problems, there has been proposed a color image forming device in which a color image is once formed on an intermediate recording medium and then transferred from the intermediate recording medium onto a paper sheet. Because the resistance value of the intermediate recording medium is substantially fixed at all times, a high-quality color image can be formed.

In this case, however, a visible image is transferred two times, that is, once onto the intermediate recording medium and once onto the paper sheet. This double transfer can cause a marked decline in image quality if the toner has low transfer efficiency.

Also, when the photosensitive drum is replaced, a new photosensitive drum may be set slightly out of position. Also, during replacement of the photosensitive drum, it may be necessary to detach or move the charging unit or the exposing unit, or these units may be accidentally moved, so that the units may become out of alignment. In these cases, poorly registered color images and undesirable color mixing can occur, resulting in poor image quality.

SUMMARY OF THE INVENTION

In view of the foregoing, it is an objective of the present invention to overcome the above problems and to provide a tandem image forming device capable of forming high-quality color images at a high rate of speed without deterioration in image quality due to Image transfers.

In order to achieve the above and other objectives, the present invention provides a color image forming device including a plurality of electrostatic latent image bearing members, a plurality of charging units, a plurality of exposing units, a plurality of developing agent bearing members, and a plurality of layer regulating units. The electrostatic latent image bearing members are aligned in a predetermined direction and have a surface. The charge units are provided in confrontation with the corresponding electrostatic latent image bearing members. The charging units uniformly charge the surface of the electrostatic latent image bearing members. The exposing units selectively emit a light onto the surface of the corresponding electrostatic latent image bearing members which has been uniformly charged by the charging units, thereby forming electrostatic latent images on the electrostatic latent image bearing members. The developing agent bearing members are disposed in confrontation with the corresponding electrostatic latent image bearing members. The developing agent bearing members bear developing agent of different color. The layer regulating units regulate a thickness of a layer of developing agent on the corresponding developing agent bearing members into a two-layer thickness or less.

There is also provided an image forming device including a plurality of developing units for different color, an intermediate recording medium, a first transfer unit, a recording medium feeding unit, a second transfer unit a feeding direction changing unit. Each of the developing units includes a developing agent bearing member that bears a non-magnetic single component developing agent, an image bearing member, and an electrostatic latent image forming unit that forms an electrostatic latent image on the image bearing member. The developing agent bearing member selectively supplies the developing agent onto the image bearing member, thereby developing a visible image corresponding to the electrostatic latent image on the image bearing member. The first transfer unit transfers the visible images from the developing unit onto the intermediate recording medium, thereby forming a color image on the intermediate recording medium. The recording medium feeding unit feeds a recording medium in a feeding direction. The recording medium has a first surface and a second surface opposite the first surface. The second transfer unit transfers the color image from the intermediate recording medium onto the recording medium. The feeding direction changing unit changes the feeding direction. The feeding direction changing unit changes the feeding direction after the color image is formed on the first surface of the recording medium for forming a subsequent color image on the second surface of the recording medium.

DETAILED DESCRIPTION OF PREFERRED EMBODIMENTS

Next, color laser printers according to preferred embodiments of the present invention will be described while referring to the accompanied drawings.

Figure 1:
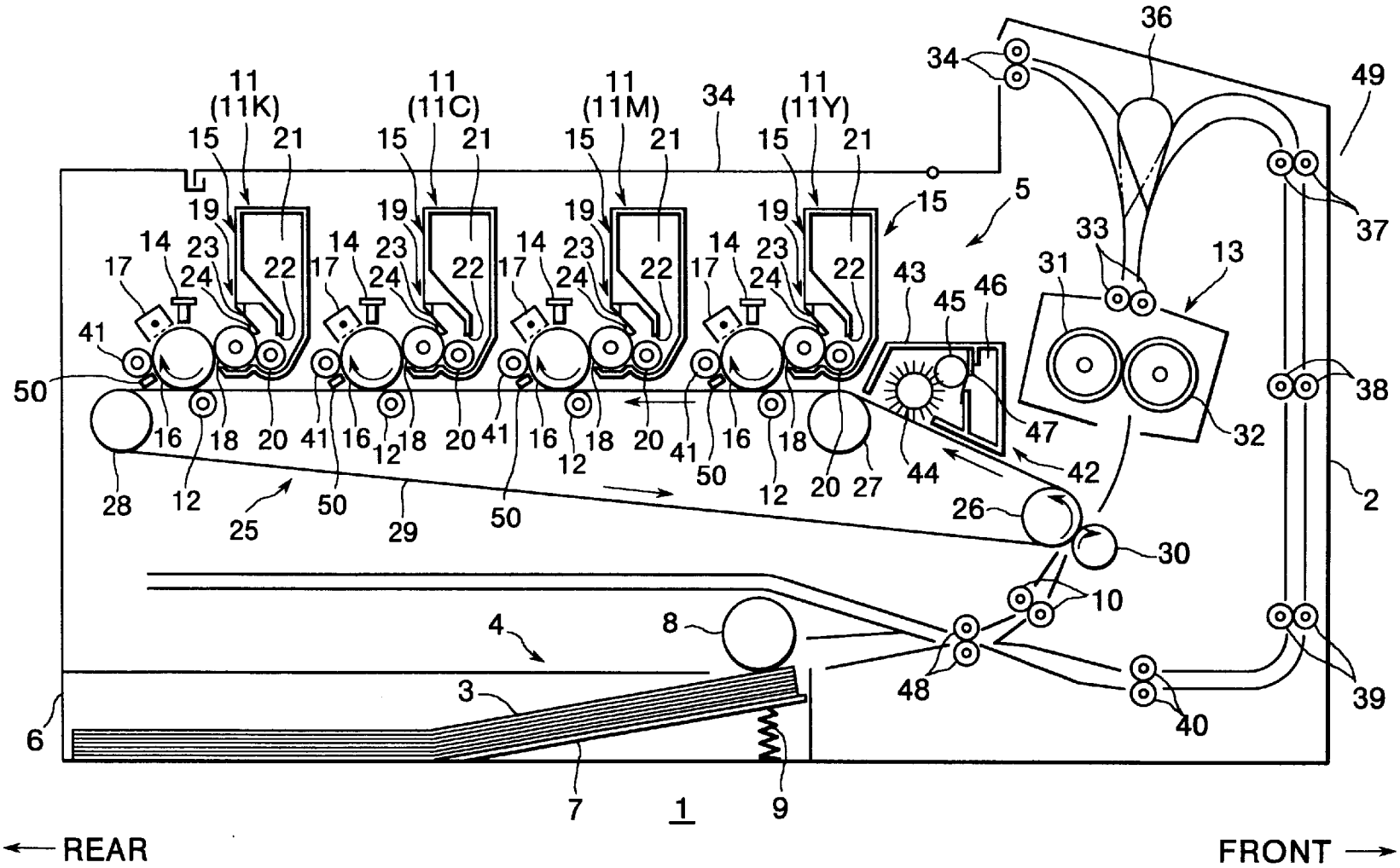
FIG. 1 is a cross-sectional side view showing a color laser printer according to a first embodiment of the present invention.

First, a color laser printer 1 according to a first embodiment of the present invention will be described while referring to FIG. 1. As shown in FIG. 1, the color laser printer 1 includes a main casing 2 accommodating a feeder unit 4 and an image forming unit 5. The feeder unit 4 is for supplying a paper sheet 3, and the image forming unit 5 forms a prescribed color image on the paper sheet 3.

The feeder unit 4 includes a sheet supply tray 6, a sheet pressure plate 7, a feed roller 8, a spring 9, and a pair of register rollers 10. The sheet pressure plate 7 is detachably mounted on the bottom of the main casing 2. The feed roller 8 is rotatable disposed above one end of the sheet supply tray 6. The sheet pressure plate 7 is provided in the sheet supply tray 6 for accommodating a stack of the paper sheet 3. The sheet pressure plate 7 is pivotable about its first end 7*a* far from the feed roller 8 so that its second end 7*b* near the feed roller 8 can move up and down. The spring 9 urges the sheet pressure plate 7 at the second end 7*b* in the upward direction. Accordingly, when more of the paper sheets 3 are stacked on the sheet pressure plate 7, the sheet pressure plate 7 pivots downward about the first end 7*a* in opposition to the urging force of the spring 9.

The topmost paper sheet 3 on the sheet pressure plate 7 is pressed against the feed roller 8, and rotation of the feed roller 8 feeds one paper sheet 3 at a time. The pair of register rollers 10 are provided downstream from the feed roller 8 in a sheet feed direction of the paper sheet 3. The register rollers 10 include a drive roller and a follower roller. The register rollers 10 register the paper sheet 3 fed by the feed roller 8, and then supply the paper sheet 3 to the image forming unit 5.

The image forming unit 5 includes a plurality of processing units 11, an intermediate transfer unit 25, a secondary image transfer roller 30, and a fixing unit 13.

The processing units 11 include a yellow developing unit 11Y, a magenta developing unit 11M, a cyan developing unit 11C, and a black developing unit 11K juxtaposed horizontally at prescribed intervals in the upper portion of the main casing 2. Each of the processing units 11 includes a developing cartridge 15, a photosensitive drum 16, an LED array 14, a scorotron charger 17, and a primary image transfer roller 12.

The developing cartridge 15 is detachably mounted in the main casing 2 and includes a developing roller 18, a toner layer thickness regulation blade 19, a feed roller 20, and a toner box 21.

The toner box 21 in each developing cartridge 15 is filled with toner. More specifically, a yellow toner is provided in the toner box 21 of the yellow developing unit 11Y, a magenta toner in the toner box 21 of the magenta developing unit 11M, cyan toner in the toner box 21 of the cyan developing unit 11C, and black toner in the toner box 21 of the black developing unit 11K. Toner in the toner box 21 is issued from a toner supply port 22 that is open on the lower side of the toner box 21.

The toner is positively charging, nonmagnetic, single component developing agent. The toner base particles have an average particle diameter of 9 $\mu$m. For producing the toner base particles, styrene-acryl-resin formed in spheres by suspension polymerization is added with well-known coloring agent, such as carbon black, and charge control agent such as quaternary ammonium salt or charge control agent provided with quaternary ammonium salt as a side chain. The surface of the toner base particle is added with silica as an outer additive. The silica, which serves as an outer additive, is processed by well-known hydrophobic processes by silane coupling agent or silicone oil. The outer additive has an average particle diameter of 10 nm, and adding amount of the outer additive is 0.6% by weight of the toner base particle. Magenta, cyan, yellow black toners are contained in the respective cartridges 15.

As described above, the toner is suspension polymerization toner with a shape extremely near to completely spherical. Also, silica processed by hydrophobic processes having the average particle diameter of 10 nm is added as outer additive in the amount of 0.6% by weight. Therefore, the toner has extremely excellent fluidity. For this reason, sufficient charge amount can be obtained by friction charging. Further, in contrast to pulverized toners, no corner or edge portion exists in the toner, the spherical toner do not undergo severe mechanical load, and provides excellent followability to the electric field, to thus enhance image transferring efficiency.

It should be noted that with a positively charged toner, it is possible to use a positive charging scorotron charger 17 (described later). Using a negatively charged toner with a negatively charged scorotron charger not in contact with the photosensitive drum 16 would generate a large amount of ozone that could degrade the operating environment. However, a satisfactory operating environment can be maintained by using the positively charged scorotron charger 17.

The feed roller 20 is rotatably disposed on the bottom of the toner supply port 22. The feed roller 20 includes a metal roller shaft covered by with a roller formed from a conductive foam material. The developing roller 18 is rotatably disposed on the back side of the feed roller 20. The developing roller 18 includes a metal roller shaft covered with a roller portion. The roller portion of the developing roller 18 is formed from a conductive urethane rubber or silicone rubber including fine carbon particles or the like covered by a coat layer of urethane rubber and silicone rubber those containing negatively charged fluorine. In the present embodiment, the developing roller 18 is applied with a bias voltage of a DC voltage of 300 V and an AC voltage of 2 kV in a superimposed manner. The feed roller 20 and the developing roller 18 contact each other such that each is compressed to a degree.

The toner layer thickness regulation blade 19 is disposed adjacent to the developing roller 18 and includes a blade 23 and a contact portion 24 provided on one end of the blade 23. The blade 23 is formed of a metal leaf spring. The other end of the blade 23 is supported by the developing cartridge 15 near the developing roller 18. The contact portion 24 is formed in a semicircle cross-sectional shape from a silicone rubber having charging capacity. The contact portion 24 contacts and applies pressure to the developing roller 18 by the elastic force of the blade 23. The average surface roughness at ten points (Rz) of the developing roller 18 is set in a range of 3 $\mu$m through 5 $\mu$m which is smaller than the average toner particle size of 9 $\mu$m.

With the above configuration, toner released through the toner supply port 22 is supplied to the developing roller 18 by the rotation of the feed roller 20. At this time, friction between the feed roller 20 and the developing roller 18 positively charges the toner. As the developing roller 18 rotates, the toner enters between the contact portion 24 and the developing roller 18 and a thin toner layer is formed on the developing roller 18. Friction is generated at this time also, thereby positively charges the toner. Because the surface of the developing roller 18 is covered with the rubber coat containing the negatively charged fluorine as described above, the positive charge of the toner is improved.

Moreover, because the contact portion 24 of the toner layer thickness regulating blade 19 is formed from a silicone rubber having a good charging capacity as described above, the toner is further effectively charged. Accordingly, the thin toner layer on the developing roller 18 is prevented from being charged with a reverse polarity, a negative polarity in this embodiment. Hence, it is possible to reduce the amount of toner undesirably transferred onto the photosensitive drum 16. Also, negatively charged toner can be prevented from becoming deposited on an endless belt 29 (described later) and from subsequently being transferred back onto the photosensitive drum 16. Accordingly, it is possible to prevent the occurrence of mixed colors caused by toner having a reverse polarity.

In this embodiment, the thin toner layer is formed to have a two-layer thickness or less (in other words, at most two toner particles are stacked in a radial direction of the developing roller 18) because the surface roughness of the developing roller 18, which is 3 $\mu$m to 5 $\mu$m, is set smaller than the average particle size of the toner, which is 9 $\mu$m. By forming the thin toner layer having this thickness, the toner comes in sliding contact with at least either one of the developing roller 18 and the toner layer thickness regulation blade 19, thereby achieving a satisfactory frictional charge. This configuration is particularly effective in a method employing a simple construction using a non-magnetic single component type developing agent.

It should be noted that in the present embodiment, the thin toner layer is defined to have a two-layer thickness or less when all the toner is stripped off the developing roller 18 by applying a mending tape or the like two times at most. The mending tape can be Scotch No. 810 manufactured by Sumitomo 3M Co., Ltd having a relatively thin adhesive layer.

A toner thin layer having the two or less layer thickness can be also formed when the contact portion 24 of the toner layer thickness regulation blade 19 and the developing roller 18 have different frictional coefficients.

The photosensitive drum 16 is disposed on the rear side of the developing roller 18 and separated by a prescribed distance therefrom. The photosensitive drum 16 is capable of rotating in a clockwise direction as indicated by an arrow in FIG. 1. A drum main body of the photosensitive drum 16 is grounded, and its surface is formed of amorphous silicon. Because the amorphous silicon greatly improves friction resistance, there is no need to replace the photosensitive drum 16. Therefore, it is possible to reliably prevent positional discrepancies of the photosensitive drum 16, the LED array 14, and the scorotron charger 17 due to replacement of the photosensitive drum 16, thereby effectively preventing poor color registration in images.

The scorotron charger 17 is disposed above the photosensitive drum 16 and separated therefrom by a predetermined distance so as not to contact the photosensitive drum 16. The scorotron charger 17 is the positive charging type scorotron charger including a charge wire formed of tungsten or the like. A corona discharge is generated from the charge wire and uniformly charges the entire surface of the photosensitive drum 16 with a positive polarity. In this embodiment, the surface of the photosensitive drum 16 is charged at a charge potential of 450 V.

Because the scorotron charger 17 is separated from the photosensitive drum 16, residual toner remaining on the photosensitive drum 16 is prevented from being deposited on the scorotron charger 17 during a toner recovery operation in a cleanerless method to be described later. This prevents an undesirable poor electric charge.

The LED array 14 is disposed above the photosensitive drum 16 and includes a plurality of LEDs for smiting light onto the surface of the photosensitive drum 16. The LED array 14 selectively exposes the photosensitive drum 16 to light based on prescribed image data. As a result, potential of the exposed portions of the photosensitive drum 16 is decreased to 100 V in the present embodiment, thereby forming an electrostatic latent image on the photosensitive drum 16.

Then, when the toner comes into opposition to the photosensitive drum 16 as the developing roller 18 rotates, the toner on the developing roller 18 selectively jumps onto the photosensitive drum 16 because of jumping effects caused by a potential difference between the developing roller 18 and the photosensitive drum 16. The potential difference is generated by the bias voltage applied to the developing roller 18. As a result, a visible toner image corresponding to the electrostatic image is developed on the photosensitive drum 16. In this way, a reversal process for each color is achieved by this jumping effect.

Since the developing roller 18 and the photosensitive drum 16 are not in contact with each other, during replacement of the developing cartridge 15 which is integrally formed with the developing roller 18, the developing roller 18 will not push the photosensitive drum 16 out of position. Hence, problems in color registration on images caused by such position displacement can be effectively prevented. Also, because toner is transferred onto the photosensitive drum 16 by the Jumping effect without the developing roller 18 contacting the photosensitive drum 16, friction is not generated between the photosensitive drum 16 and the developing roller 18. Hence, the driving performance of the photosensitive drum 16 will not fluctuate due to such friction, thereby preventing poor color registration. Further, because toner is not rubbed between the developing roller 18 and the photosensitive drum 16, deterioration of the toner will be reduced. Also, the external additives of the polymerized toner are prevented from becoming embedded into its base particles. It should be noted that because the surface of the photosensitive drum 16 is formed from a rigid amorphous silicon as described above, toner would be greatly deteriorated if the toner was rubbed by the photosensitive drum 16.

The primary image transfer roller 12 is disposed downstream of the developing roller 18 in the rotational direction of the photosensitive drum 16 and diagonally below the photosensitive drum 16 with an endless belt 29 interposed therebetween. The primary image transfer roller 12 includes a metal roller shaft covered with a roller portion formed of a conductive rubber material. A visible toner image formed on the photosensitive drum 16 is transferred onto the endless belt 29 which is passing between the photosensitive drum 16 and the primary image transfer roller 12.

The intermediate transfer unit 25 Is disposed below the photosensitive drums 16. The intermediate transfer unit 25 includes the endless belt 29, a first roller 26, a second roller 27, and a third roller 28. The first roller 26 is provided downstream from the register rollers 10 in the sheet feed direction. The second roller 27 is disposed below the yellow developing unit 11Y and diagonally above the first roller 26. The third roller 28 is disposed below the black developing unit 11K and separated from the second roller 27 by a prescribed distance in the horizontal direction. The endless belt 29 is wound around the periphery of the first roller 26, the second roller 27, and the third roller 28 such that the endless belt 29 extend in a triangular shape. The portion of the endless belt 29 between the second roller 27 and the third roller 28 extends in the horizontal direction while being sandwiched between the photosensitive drums 16 and the corresponding primary image transfer rollers 12. The endless belt 29 is formed of a resin, such as a conductive polycarbonate or polyimide, with a dispersed conductive particles, such as carbon.

Rotation of the rollers 26 to 28 transfers the endless belt 29 in a direction indicated by arrows in FIG. 1. While a section of the endless belt 29 passes across each photosensitive drum 16 in order, toner images of each color are transferred from each photosensitive drum 16 in an overlaid manner, thereby forming a single visible color image on the section. More specifically, a yellow toner image formed on the photosensitive drum 16 of the yellow developing unit 11Y is transferred onto the endless belt 29. Subsequently, a magenta toner image formed on the photosensitive drum 16 of the magenta developing unit 11M is transferred and overlaid on the yellow toner image on the endless belt 29. This process is repeated for a cyan toner image formed by the cyan developing unit 11C and a black toner image formed by the black developing unit 11K. Each toner image is overlaid in turn to form a single visible color image on the endless belt 29.

The secondary image transfer roller 30 is disposed to oppose the first roller 26, and is rotatable in the clockwise direction as indicated by an the arrow in FIG. 1. The secondary image transfer roller 30 includes a metal roller shaft covered with a roller portion formed of a conductive rubber material, and is applied with a prescribed transfer bias. The color image formed on the endless belt 29 is transferred to the paper sheet 3 passing between the endless belt 29 and the secondary image transfer roller 30.

In this way, toner images on each photosensitive drum 16 are once transferred to and overlaid on the endless belt 29, thereby forming a color image. Subsequently, the color image is transferred from the endless belt 29 onto the paper sheet 3 by the secondary image transfer roller 30. That is, toner images are not directly transferred from the photosensitive drum 16 onto the paper sheet 3. Therefore, a stable transfer of toner images can be properly achieved while preventing color mixing.

In the present embodiment, a visible toner image is transferred twice, that is, once from the photosensitive drum 16 onto the endless belt 29, and once from the endless belt 29 onto the paper sheet 3. However, because a polymerized toner having a superior transferring efficiency is used In the present embodiment, deterioration in image quality due to transferring the toner images twice can be prevented.

The fixing unit 13 is disposed above and downstream of the secondary image transfer roller 30 in the sheet feed direction. Further, a flapper 36 is disposed above and downstream of the fixing unit 13 in the sheet feed direction. The fixing unit 13 includes a heating roller 31, a pressure roller 32, and a pair of conveying rollers 33. The heating roller 31 is formed of metal and includes a halogen lamp for generating heat. The pressure roller 32 applies pressure to the heating roller 31. The pair of conveying rollers 33 are disposed downstream of the heating roller 31 and the pressure roller 32 in the sheet feed direction. As the paper sheet 3 formed with a color image thereon passes between the heating roller 31 and the pressure roller 32, the heat from the heating roller 31 fixes the color image onto the paper sheet 3. The conveying rollers 33 subsequently convey the paper sheet 3 toward the flapper 36.

A pair of discharge rollers 34 are disposed rear side of and downstream from the flapper 36 in the sheet feed direction. When the flapper 36 is in a paper discharge position (described later), the paper sheet 3 is further transferred to the discharge rollers 34 and discharged onto a paper discharge tray 35.

In the color laser printer 1 of the present embodiment, toner remaining on the photosensitive drum 16 after image transfer onto the endless belt 29 is performed (hereinafter referred to as "residual toner") is recovered by a cleanerless method by the developing roller 18. With this configuration, there is no need to provide a waste toner accommodating section for recovering residual toner in each of the processing units 11. Accordingly, there is no need to replace these waste toner accommodating sections, thereby greatly reducing maintenance time and costs. Moreover, user's hand will not be soiled from the waste toner recovered into the waste toner accommodating section when replacing the same, which is usually opened toward the photosensitive drum 16. In addition, the positions of the LED array 14, the scorotron charger 17, and the like are not disturbed from operations to replace the waste toner accommodating sections, thereby improving the reliability of the color laser printer 1.

It should be noted that if a waste toner accommodating section is provided while replacement of the photosensitive drum 16 is unnecessary as in the present embodiment, the photosensitive drum 16 cannot be formed integrally with the toner box 21 and the waste toner accommodating section, which are normally disposed on opposite sides of the photosensitive drum 16, in order that all these components can be replaced together. In this case, considerable effort would be required for replacing the toner box 21 and the waste toner accommodating section separately. However, according to the present embodiment, because there is no need to provide a waste toner accommodating section, the trouble of replacing parts can be greatly reduced.

Each of the processing units 11 also includes a cleaning roller 41 for temporarily recovering residual toner. The cleaning roller 41 is provided in contact with the photosensitive drum 16 at position downstream of a position where the photosensitive drum 16 contacts the endless belt 29 and upstream of the scorotron charger 17 in the rotational direction of the photosensitive drum 16. The cleaning roller 41 includes a metal roller shaft covered with a roller portion formed of a conductive rubber material, such as silicone rubber, urethane rubber, EPDM, or the like. The cleaning roller 41 is applied with a prescribed bias voltage. The prescribed bias voltage is set to maintain the potential difference between the cleaning roller 41 and the photosensitive drum 16 in a range that does not generate electric discharge therebetween. Because of the potential difference, the cleaning roller 41 can electrically retain the residual toner or release the toner back to the photosensitive drum 16.

When residual toner on the photosensitive drum 16 comes to opposite the cleaning roller 41 by the rotation of the photosensitive drum 16, a bias voltage of reverse polarity to the photosensitive drum 16 is applied to the cleaning roller 41. As a result, the cleaning roller 41 electrically recovers the residual toner from the photosensitive drum 16.

The cleaning roller 41 continues collecting and holding residual toner when the cleaning roller 41 opposes an image area on the photosensitive drum 16. The image area is a prescribed area in which a toner image is to be formed next after passing the cleaning roller 41.

On the other hand, when the cleaning roller 41 opposes a non-image area of the photosensitive drum 16, the polarity of the bias voltage applied to the cleaning roller 41 is changed. The non-image area is a prescribed area In which a toner image to be transferred onto the endless belt 29 is not formed after passing the cleaning roller 41. By changing the polarity of the bias voltage, the recovered toner is released back onto the non-image area of the photosensitive drum 16. That is, the collected toner can be released back onto the photosensitive drum 16 at a timing when the released toner will not be deposited in the image area on the photosensitive drum 16.

The amount of residual toner can be increased by changes in environmental factors, endurance of components, and other transfer conditions. However, with the above configuration, even if the amount of residual toner is increased more than that can be recovered by the developing roller 18 alone, the cleaning roller 41 can recover the residual toner. In this way, the effects of residual toner on the toner image formed on the photosensitive drum 16 can be reduced, thereby achieving reliable developing and transfer processes.

The scorotron charger 17 is at least operated when the residual toner released back onto the photosensitive drum 16 is moved to a position opposite the scorotron charger 17 by the rotation of the photosensitive drum 16. In this way, the released toner can be reliably charged with a positive polarity by the scorotron charger 17. Accordingly, negatively charged residual toner can be recharged with a positive polarity, and positively charged residual toner can be increased in its charging amount.

Then, the positively charged released toner is moved to the developing roller 16 by the rotation of the photosensitive drum 16. The bias voltage applied to the developing roller 18 causes the toner to jump back to the developing roller 18, thereby recovering the released toner. Because the positive charge amount of the toner has been increased, the developing roller 18 can reliably recover the residual toner at this time.

Each process unit 11 is also provided with a charge-removing lamp 50 disposed at a position between the primary image transfer roller 12 and the cleaning roller 41 so as to oppose the photosensitive drum 16 while keeping a predetermined distance therefrom. After a toner image has been transferred onto the endless belt 29, the charge removing lamp 50 emits light to lower the potential on the surface of the photosensitive drum 16 to approximately 100 V in the present embodiment, thereby securing a prescribed potential difference between the surface of the photosensitive drum 16 and the cleaning roller 41. This facilitates the collection of residual toner by the cleaning roller 41.

A cleaner 42 is provided above the intermediate transfer unit 25 between the first roller 26 and the second roller 27 for recovering toner residual remaining on the endless belt 29 after a color image has been transferred onto the paper sheet 3. The cleaner 42 includes a cleaner casing 43, and also includes a cleaner brush 44, a recovery roller 45, a recovery box 46, and a scraping blade 47, all accommodated in the cleaner casing 43.

The cleaner brush 44 is formed of brush-like bristles extending outward from a cylindrical body. The cleaner brush 44 is rotatable supported at a position where the bristles contact the endless belt 29. A bias is applied to the cylindrical body of the cleaner brush 44 to maintain a prescribed potential difference from the endless belt 29.

The recovery roller 45 is a metal roller rotatably disposed on the front side of the cleaner brush 44 in contact with the bristles of the cleaner brush 44. A bias is applied to the recovery roller 45 to maintain a prescribed potential difference with the cleaner brush 44.

The recovery box 46 is positioned on the front side of the recovery roller 45 and has an opening portion opposing the recovery roller 45. The scraping blade 47 is disposed near the opening portion. The scraping blade 47 is pressed against the recovery roller 45.

When residual toner on the endless belt 29 is moved to the cleaner 42, the cleaner brush 44 scrapes the surface of the endless belt 29, thereby collecting the residual toner. Also, the bias applied to the cleaner brush 44 causes the residual toner to adhere to the bristles. When the residual toner deposited on the cleaner brush 44 comes in contact with the recovery roller 45 by rotation of the cleaner brush 44, the bias applied to the recovery roller 45 causes the toner to adhere thereon. Subsequently, the toner is scraped off the recovery roller 45 by the scraping blade 47 to be recovered in the recovery box 46.

A reverse direction conveying unit 49 is provided for enabling image forming on both surfaces of the paper sheet 3. The reverse direction conveying unit 49 includes the flapper 36, a plurality of pairs of conveying rollers 37 through 40, and a pair of reversing rollers 48. The flapper 36 is disposed above the fixing unit 13 and downstream from the conveying rollers 33 in the sheet feed direction. The flapper 36 is capable of pivoting between a discharge position indicated by a solid line in FIG. 1 for conveying the paper sheet 3 toward the discharge rollers 34 and a reversing position indicated by a dotted line in FIG. 1 for conveying the paper sheet 3 toward the secondary image transfer roller 30.

Each pair of conveying rollers 37 through 40 include a drive roller and a follower roller for feeding the paper sheet 3 from the flapper 36 toward the reversing rollers 48. Specifically, the conveying roller 37 is positioned on the front side of the flapper 36. The conveying roller 38 is positioned below the conveying roller 37. The conveying roller 39 is positioned below the conveying roller 38. The conveying roller 40 is provided to the rear side of the conveying roller 39.

When the flapper 36 is in the reversing position, the paper sheet 3 fed from the fixing unit 13 is transported toward the conveying roller 37. The conveying rollers 37 and 38 convey the paper sheet 3 downward to the conveying roller 39, which conveys the paper sheet 3 to the conveying roller 40 and subsequently to the reversing rollers 48.

The reversing rollers 48 are positioned between the feed roller 8 and the register rollers 10, and include a drive roller and a follower roller. The paper sheet 3 delivered from the conveying roller 40 is transported through the reversing rollers 48 until a trailing end of the paper sheet 3 is interposed between the reversing rollers 48. Then, the rotational direction of the reversing rollers 48 is reversed and the paper sheet 3 is conveyed toward the register rollers 10. The sheet feed path between the conveying roller 40 and the reversing rollers 48 is formed narrower toward the reversing rollers 48. This configuration enables the paper sheet 3 to be conveyed from the conveying roller 40 to the reversing rollers 48 while preventing the paper sheet 3 from being conveyed back from the reversing rollers 48 to the conveying roller 40. Accordingly, the paper sheet 3 moves toward the register rollers 10 without returning to the conveying roller 40.

Then, the paper sheet 3 is properly registered by the register rollers 10, and transported between the endless belt 29 and the secondary image transfer roller 30 while its surface on which a color image is not formed confronts the endless belt 29. Then, a color image is formed on the side of the paper sheet 3 opposite the surface already formed with a color image. Subsequently, the fixing unit 13 fixes the color image onto the paper sheet 3, completing the formation of the color images on both surfaces of the paper sheet 3.

Because color images are formed on both surfaces of the paper sheet 3, the amount of paper sheet 3 consumed is reduced. Accordingly, the color laser printer 1 is friendly to the environment by reducing the consumption of natural resources.

It should be noted that the resistance value of the paper sheet 3 can change when a color image is formed on its back surface after fixing a color image onto its front surface. However, a color image on the photosensitive drums 16 is not transferred directly onto the paper sheet 3, Changes in the resistance values do not affect the image transfer, and images can be reliably transferred from the photosensitive drum 16. With this configuration, even though the developing roller 18 recovers the residual toner by the cleanerless method, high quality multicolor images can be formed without the problem of mixing colors.

In the color laser printer 1 described above, a non-magnetic single component type toner does not remain on the photosensitive drum 16 in large amounts although the magnetic toner does. Therefore, the cleanerless method can reliably recover residual toner by the developing roller 18, thereby achieving high quality image formation. Also, because the polymerized toner has good fluidity, the toner is effectively transferred from the photosensitive drum 16 onto the endless belt 29, remarkably reducing the amount of residual toner. Since the polymerized toner has good fluidity and is not influenced by frictional forces and the like, the toner tends to behave according to the force of the electric field. Therefore, the developing roller 18 can reliably collect residual polymerized toner on the photosensitive drum 16 by properly charging the toner. Because polymerized toner transferred to the endless belt 29 hardly becomes re-deposited on the photosensitive drum 16, the mixing of colors is properly prevented.

It should be noted that depending on the object and application for a color laser printer, it is possible to form a color image without providing the endless belt 29, but by directly transferring each visible toner image carried on each photosensitive drum 16 to the paper sheet 3 in order.

It should be also noted that depending on the specifications and conditions of image formation, it is possible to collect residual toner by the developing roller 18 without using the cleaning roller 41. In this case, the scorotron charger 17 is operated when rotation of the photosensitive drum 16 brings the residual toner opposite the scorotron charger 17. The scorotron charger 17 charges the residual toner with a positive polarity in order that the developing roller 18 can reliably recover the toner.

Further, because the toner thin layer formed on the developing roller 18 is set to have a two-layers thickness or less (at most two toner particles are stacked on the developing roller 18 in its radial direction), the toner can be properly and uniformly charged. This reduces the amount of unproperly charged toner. Therefore, undesirable transfer of the toner onto the endless belt 29 is prevented. Such toner is prevented from being transferred to a next developing unit via the endless belt 29. The occurrence of mixed colors can be reliably reduced although the cleanerless method is used.

Further, because the polymerized toner is used, the charge control agent can be more uniformly dispersed than when pulverized toner is used. Hence, it is possible to more reliably generate a uniform charge in the toner.

Further, the charge control agent of the present embodiment is a charge control resin having quaternary ammonium salt as a side chain or a resin added with quaternary ammonium salt. Therefore, sufficient dispersion on the resin results, enabling a satisfactory uniform charge formed on the toner. Further, the charge control agent is colorless, which is more suitable for use with color toner.

Next, a color laser printer 1A according to a second embodiment of the present invention will be described while referring to FIG. 2, wherein like parts and components are designated by the same reference numerals to avoid duplicating description.

Figure 2:
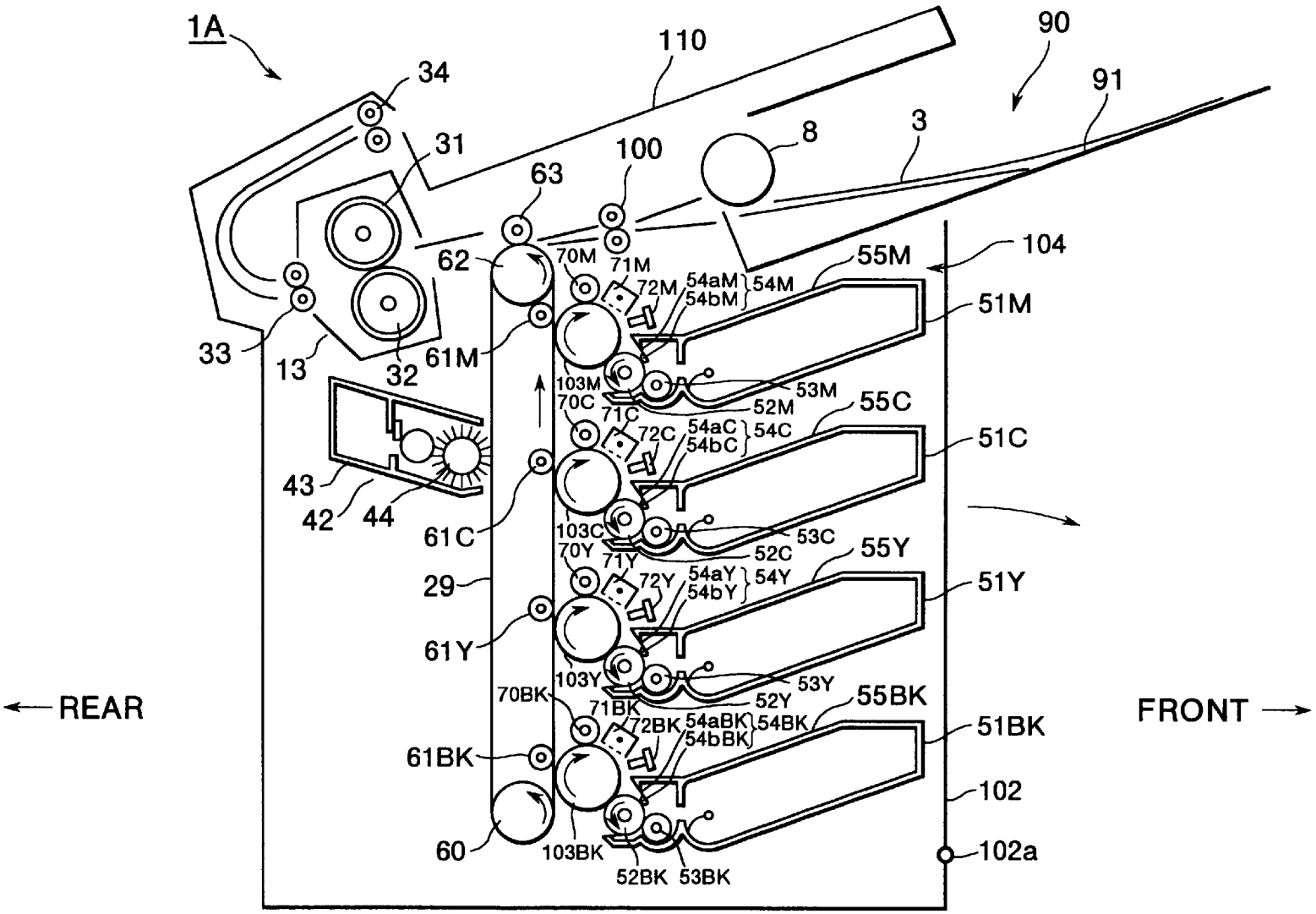
FIG. 2 is a cross-sectional side view showing a color laser printer according to a second embodiment of the present invention.

As shown in FIG. 2, the color laser printer 1A is provided with a process unit 104, an endless belt 29, a fixing unit 13, a sheet supply unit 90, and a sheet discharge tray 110.

The process unit 104 includes developing units 51M, SIC, 51Y, 51Bk for forming toner image of each color, that is, magenta (M), cyan (C), yellow (Y), and black (Bk). Each developing unit 51M. 51C, 51Y, 51Bk includes a developing unit case 55M, 55C, 55Y, 55Bk, a feed roller 53M, 53C, 53Y. 53Bk, a photosensitive drum 103M, 103C, 103Y, 103Bk, a cleaning roller 70M, 70C, 70Y, 70Bk, a charger 71M, 71C, 71Y, 71Bk, and an exposing unit 72M, 72C, 72Y, 72Bk, respectively.

The developing roller 52M, 52C, 52Y, 52Bk includes cylindrical base formed of a conductive silicone rubber, and its surface is coated with a resin or rubber containing fluorine. Alternatively, the developing roller 52M, 52C, 52Y, 52Bk can be formed of a base material containing conductive urethane rubber. The average surface roughness Rz of the developing roller 52M, 52C, 52Y, 52Bk is set at 3–5 $\mu$m, which is smaller than the average toner particle size of 9 $\mu$m. A prescribed voltage is applied to the developing roller 52M, 52C, 52Y, 52Bk to achieve a prescribed potential differential between the developing roller 52M, 52C, 52Y, 52Bk and the corresponding photosensitive drum 103M, 103C, 103Y, 103Bk.

The rotational peripheral speed of the developing roller 52M, 52C, 52Y, 52Bk is set at least 1.4 times faster than that of the photosensitive drum 103M, 103C, 103Y, 103Bk. In the present embodiment, the peripheral speed of the developing roller 52M, 52C, 52Y, 52Bk is set 1.6 times faster than that of the photosensitive drum 103M, 103C, 103Y, 103Bk.

The feed roller 53W, 53C, 53Y, 53Bk includes conductive sponge roller and is rotatably disposed in contact with the developing roller 52M, 52C, 52Y, 52Bk, such that the feed roller 53W, 53C, 53Y, 53Bk applies pressure to the developing roller 52W, 52C, 52Y, 52Bk by the elastic force of the sponge material. Alternatively, the feed roller 53M, 53C, 53Y, 53Bk can be formed from a proper conducting material, such as silicone rubber or urethane rubber.

The developing unit 51M, 51C, 51Y, 51Bk is also provided with a toner layer thickness regulation blade 54M, 54C, 54Y, 54Bk for forming a thin toner layer on the developing roller 52M, 52C, 52Y, 52Bk. The thin toner layer is formed to have a two-layer thickness or less as the same as in the first embodiment. The toner layer thickness regulation blade 54M, 54C, 54Y, 54Bk is formed of a stainless steel material and includes a support portion 54aM, 54aC, 54aY, 54aBk and a contact portion 54bM, 54bC, 54bY, 54bBk. The support portion 54aM, 54aC, 54aY, 54aBk is fixed to the developing unit case 55M, 55C, 55Y, 55Bk. The contact portion 54bM, 54bC, 54bY, 54bBk is provided on the end of the support portion 54aM, 54aC, 54aY, 54aBk. The contact portion 54bM, 54bC, 54bY, 54bBk is formed of a conductive silicone rubber, a conductive rubber, or resin containing fluorine. It is particularly desirable to form the contact portion 54bM, 54bC, 54bY, 54bBk from a conductive silicone rubber having a superior charging capacity. The contact portion 54bM, 54bC, 54bY, 54bBk contacts and applies pressure to the developing roller 52M, 52C, 52Y, 52Bk through the elastic force of the support portion 54aM, 54aC, 54aY, 54aBk. As shown in FIG. 2, the contact portion 54bM, 54bC, 54bY, 54bBk has a semicircular cross-sectional shape. A prescribed voltage is applied to the toner layer thickness regulation blade 54M, 54C, 54Y, 54Bk.

The photosensitive drum 103M, 103C, 103Y, 103Bk is a positively charged photosensitive layer formed over a base material of aluminum, for example. The thickness of the photosensitive layer is 18 $\mu$m or more. Further, the aluminum base material serves as a grounded layer. The photosensitive drum 103M, 103C, 103Y, 103Bk rotates in the direction indicated by arrows in FIG. 2. In the present embodiment, the photosensitive drum 103M, 103C, 103Y, 103Bk is set to rotate at a rotational peripheral speed different from the moving speed of the endless belt 29. Here, the velocity of the endless belt 29 is set approximately 1% through 5% faster than the rotational peripheral speed of the photosensitive drum 103M, 103C, 103Y, 103Bk. If the difference is less than 1%, sufficient effect cannot be obtained. If the difference is greater than 5%, an image may be distorted.

The cleaning roller 70M, 70C, 70Y, 70Bk is formed from an elastic member, such as a conductive sponge, and slidingly contacts the photosensitive drum 103M, 103C, 103Y. 103Bk. A power source (not shown) applies voltage having a negative polarity, that is, opposite the polarity of the toner, to the cleaning rollers 70M, 70C, 70Y, 70Bk. Residual toner on the photosensitive drum 103M, 103C, 103Y, 103Bk is removed therefrom because of the sliding force of the cleaning roller 70M, 70C, 70Y, 70Bk against the photosensitive drum 103M, 103C, 103Y, 103Bk and also of the electric field generated by the voltage. In the present embodiment, the residual toner is recovered in the cleanerless method described in the first embodiment. Therefore, the residual toner can be removed by the cleaning roller 70M, 70C, 70Y, 70Bk, and then transferred back onto the photosensitive drum 103M, 103C, 103Y, 103Bk in a prescribed cycle following completion of the developing process.

The charger 71M, 71C, 71Y, 71Bk is scorotron type charging device. The charger 71M, 71C, 71Y, 71Bk is disposed opposite the surface of the photosensitive drum 103M, 103C, 103Y, 103Bk downstream from the cleaning roller 70M, 70C, 70Y, 70Bk in the rotational direction of the photosensitive drum 103M, 103C, 103Y, 103Bk. Alternatively. the charger 71M, 71C, 71Y, 71Bk can be a roller type charger that contacts the photosensitive drum 103M, 103C, 103Y, 103Bk.

The exposing unit 72M, 72C, 72Y, 72Bk is an LED-type light source, and is disposed opposing the surface of the photosensitive drum 103M, 103C, 103Y, 103Bk and downstream from the charger 71M, 71C, 71Y, 71Bk in the rotational direction of the photosensitive drum 103M, 103C, 103Y, 103Bk. The exposing unit 72K, 72C, 72Y, 72Bk emits light based on Image data onto the surface of the photosensitive drum 103M, 103C, 103Y, 103Bk to form an electrostatic latent image for each color thereon.

With this oonfiguration, the positively charged toner properly forms a toner image corresponding to the electrostatic latent images, which have a positive polarity. on the photosensitive drum 103M, 103C, 103Y, 103Bk by the reversal process at the point where the developing roller 52M, 52C, 52Y, 52Bk and the photosensitive drum 103M, 103C. 103Y, 103Bk contact each other. As a result, an extremely high-quality image can be formed.

The endless belt 29 is looped around two drive rollers 60 and 62. An intermediate transfer roller 61M, 61C, 61Y, 61Bk is disposed at a position opposing the photosensitive drum 103M, 103C, 103Y, 103Bk across from the endless belt 29. As shown in FIG. 2, the surface of the endless belt 29 on the side opposing the photosensitive drum 103M, 103C, 103Y, 103Bk moves vertically in the direction from bottom to top.

A prescribed voltage is applied to the intermediate transfer roller 61M, 61C, 61Y, 61Bk in order that the toner image formed on the photosensitive drum 103M, 103C, 103Y, 103Bk is transferred to the endless belt 29. A roller 63 is disposed opposing the drive roller 62 in a position at which the toner image is transferred onto the paper sheet 3. A prescribed voltage is also applied to the roller 63. As a result, a toner image in four colors carried on the endless belt 29 is transferred onto the paper sheet 3.

A cleaner 42 is provided on the side of the endless belt 29 opposite from the photosensitive drum 103M, 103C, 103Y, 103Bk. The cleaner 42 includes a cleaner brush 44 and a cleaner casing 43 accommodating the cleaner brush 44. The cleaner brush 44 scrapes residual toner from the endless belt 29.

The fixing unit 13 includes a heating roller 32 and a pressure roller 31. A paper sheet 3 formed with a color image is fed between the heating roller 32 and the pressure roller 31, the pressure roller 31 and the heating roller 32 apply heat and pressure to fix the color image on the paper sheet 3.

The sheet supply unit 90 includes a tray 91 for accommodating a paper sheet 3 and a feed roller 8 for feeding the paper sheet 3. The teed roller 8 feeds the paper sheet 3 at a prescribed timing with the image forming process performed by the process unit 104 and the endless belt 29. The paper sheet 3 fed by the feed roller 8 is conveyed by a pair of conveying rollers 100 to the point of contact between the drive roller 62 and the roller 63.

The sheet discharge tray 110 is provided on the discharge end of the fixing unit 13 and accommodates paper sheet 3 discharged by a pair of conveying rollers 31, 34.

A front cover 102 is pivotable in the direction indicated by an arrow shown in FIG. 2 about a shaft 102*a*. By opening the front cover 102, the developing unit 51M, 51C, 51Y, 51Bk can be easily replaced.

Next, the operations of the color laser printer 1A according to the second embodiment will be described. First, the chargers 71M, 71C, 71Y, 71Bk generate a uniform charge across the entire photosensitive layer on the photosensitive drums 103M, 103C, 103Y, 103Bk. Then, the photosensitive layer is selectively exposed to LED light from the exposing units 72M, 72C, 72Y, 72Bk, thereby forming an electrostatic latent image. Next, the developing units 51M, 51C, 51Y, 51Bk deposit magenta, cyan. yellow, and black toner, respectively, on the photosensitive drums 103M, 103C, 103Y, 103Bk, thereby developing the magenta, cyan, yellow, and black toner images corresponding to the electrostatic latent images.

The toner images of each color are transferred onto the endless belt 29 at a slight time differential corresponding to the velocity of the endless belt 29 and the positions of the photosensitive drums 103M, 103C, 103Y, 103Bk. In this way, the toner images are overlaid in turn with the same alignment and registration, thereby forming a color image. Residual toner remaining on the photosensitive drums 103M, 103C, 103Y, 103Bk is removed by the cleaning rollers 70M, 70C, 70Y, 70Bk.

Then, the color image formed on the endless belt 29 is transferred onto the paper sheet 3 fed from the sheet supply unit 90 at the position between the roller 63 and the endless belt 29. The color toner image is then fixed to the paper sheet 3 in the fixing unit 13. The paper sheet 3 is discharged onto the street discharge tray 110, thereby completing the formation of the color toner image.

Because the color laser printer 1A of the second embodiment performs the image forming operations in the tandem image-forming method as described above, it is possible to form a color image at a high speed approximately equivalent to that for forming a single color image.

Because the endless belt 29 provides a long surface opposing the photosensitive drums 103M, 103C, 103Y, 103Bk, the plurality of developing units 51M, 51C, 51Y, 51Bk can be juxtaposed in the vertical direction as described above. However, like the first embodiment, the developing units 51M, 51C, 51Y, 51Bk can be juxtaposed in the horizontal direction instead.

In the present embodiment, the peripheral speed of the developing roller is set at least 1.4 times faster than that of the photosensitive drum as described above. Therefore, it is possible to supply a large amount of toner to form a high-toner-density toner image, even when the toner layer on the developing roller is set to have a two-layer thickness or less.

It should be noted that the toner layer carried on the developing roller has a two-layer thickness or less. However, because the rotational peripheral speed of the developing roller is set faster than that of the photosensitive drum, the toner layer transferred onto the photosensitive drum has a two-layer thickness or more. Accordingly, the toner image transferred onto the endless belt has the two-layer thickness or more.

At this time, the lowermost layer of the toner image directly contacts the endless belt. Therefore, the lowermost layer is adhered onto the endless belt. However, the remaining layers of the toner image do not contact the endless belt. When such toner image is transported downstream to a next developing unit, the uppermost layer and an intermediate layer, if any, of the toner image comes into contact with a next photosensitive drum of the next developing unit without contacting the endless belt. When the adhering force between the uppermost layer and the next photosensitive drum is strong, the uppermost layer may be transferred onto the photosensitive drum. Further, when the pressing force between the endless belt and the photosensitive drum is high, toner particles may be congregated together mass. In this case, not only the uppermost layer, but the entire toner image will be transferred from the endless belt onto the photosensitive drum.

However, according to the present invention, because the rotational peripheral speed of the photosensitive drum is different from the moving speed of the endless belt by 1% through 5%, shearing force can be imparted on the congregated mass and break the solidified toner particles and separates the toner particles from one another. Also, the shearing force provides rolling motion to the toner particles along the endless belt. This greatly reduces the adhering force between the photosensitive drum and the toner, thereby preventing the toner image from transferring from the endless belt onto the photosensitive drum. Consequently, the toner mobility can be merely dependent on the electric filed applied thereto.

Also, because of the high peripheral speed rate of the developing rollers, the residual toner can be effectively recovered even by the cleanerless method. As a result, it is possible to reliably prevent the mixing of colors.

Further, in the present embodiment, the photosensitive drum and the endless belt are set at different speeds. This configuration can effectively and reliably prevent the mixing of colors when the adhesive strength of the toner is somewhat large, without toner moving against the force of the electric field.

Next, a color laser printer 1B according to a third embodiment of the present invention will be described with reference to FIG. 3, wherein like parts and components are designated by the same reference numerals as those sown An FIGS. 1 and 2 to avoid duplicating description.

Figure 3:
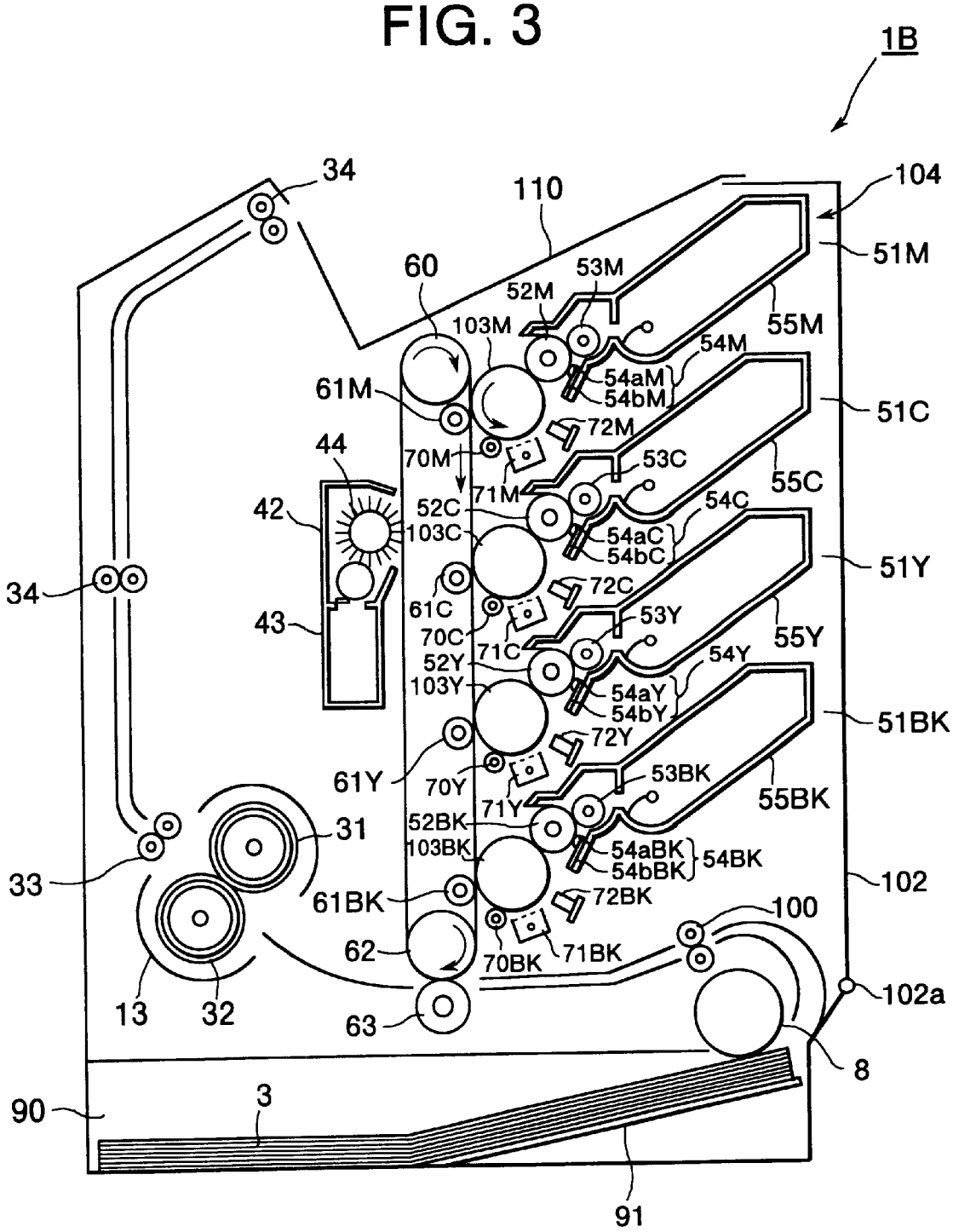
FIG. 3 is a cross-sectional side view showing a color laser printer according to a third embodiment of the present invention.

As shown in FIG. 3, the third embodiment differs from the second embodiment in the direction that the endless belt 29 moves in relation to the photosensitive drums 103M, 103C, 103Y, 103Bk. That is, in the third embodiment, the surface of the endless belt 29 opposing the photosensitive drums 103M, 103C, 103Y, 103Bk moves from top to bottom. With this configuration, the sheet supply unit 90 and the roller 63 are disposed at positions below the endless belt 29.

Since the photosensitive drums 103M, 103C, 103Y, 103Bk rotate in the counterclockwise direction as viewed in FIG. 3, the cleaning rollers 70M, 70C, 70Y, 70Bk, the chargers 71M, 71C, 71Y, 71Bk, and the exposing units 72M, 72C, 72Y, 72Bk are positioned below the photosensitive drums 103M, 103C, 103Y, 103Bk. Further, the toner layer thickness regulation blades 54M, 54C, 54Y, 54Bk are positioned below the developing rollers 52M, 52C, 52Y, 52Bk.

With this configuration, it is not necessary to configure the sheet supply unit 90 to protrude externally from the color laser printer 1B, thereby providing a more compact color laser printer 1B. Moreover, the thin toner layer on the developing rollers 52M, 52C, 52Y, 52Bk in the present embodiment is set to have a two-layer thickness or less. Accordingly, deterioration in image quality caused by image transfers can be reliably prevented even when the endless belt 29 is used.

The present invention may also be applied to other image forming devices, such as a copying machine or a device using a non-magnetic single component type developing agent other than a suspension polymerized toner. An example of the latter is an image forming device that includes a polymerized toner produced by emulsion polymerization and the like.

While the invention has been described in detail with reference to specific embodiments thereof, it would be apparent to those skilled in the art that various changes and modifications may be made therein without departing from the spirit of the invention, the scope of which is defined by the attached claims.

For example, the toner can be a polymerized toner formed from a polymeric monomer, such as stylene or a stylene type monomer, acrylic acid, alkyl (C1–C4) acrylate, alkyl (C1–C4) metaacrylate, or other acrylic monomers. The polymeric monomer is copolymerized using a well-known polymerization method, such as suspension polymerization. This type of polymerized toner has spherical particles extremely good fluidity. Toner is combined with wax or the like and includes silica or similar external additives for improving fluidity. The average particle size of this polymerized toner is approximately 6–10 $\mu$m.

What is claimed is:

1. A color image forming device comprising:

a plurality of electrostatic latent image bearing members aligned in a predetermined direction, each having a surface;

a plurality of charging units disposed in confrontation with the corresponding electrostatic latent image bearing members, the charging units uniformly charging the surface of the electrostatic latent image bearing members;

a plurality of exposing units that selectively emit a light onto the surface of the corresponding electrostatic latent image bearing members which has been uniformly charged by the charging units, thereby forming electrostatic latent images on the electrostatic latent image bearing members;

a plurality of developing agent bearing members disposed in confrontation with the corresponding electrostatic latent image bearing members, the developing agent bearing members bearing developing agent of different color;

a plurality of layer regulating units for regulating a thickness of a layer of developing agent on the corresponding developing agent bearing members into a two-layer thickness or less, wherein each layer of developing agent contacts at least one of the developing agent bearing member or a developing agent thickness regulation blade, thereby charging each layer of developing agent;

an intermediate recording medium movable in the predetermined direction, wherein the developing agent bearing members selectively supply the developing agent onto the corresponding electrostatic latent image bearing members, thereby developing visible images corresponding to the electrostatic latent images on the electrostatic latent image bearing members; and a plurality of transfer units that transfer the visible images from the electrostatic latent image bearing members onto the intermediate recording medium at transferring positions, thereby forming a color image on the intermediate recording medium.

2. The color image forming device according to claim 1, wherein the layer thickness regulating units include the developing agent bearing members and a plurality of layer thickness regulating members disposed in contact with the corresponding developing agent bearing members, the developing agent bearing members having a frictional coefficient different from a frictional coefficient of the corresponding layer thickness regulating members.

3. The color image forming device according to claim 1, wherein the layer thickness regulating units include the developing agent bearing members and a plurality of layer thickness regulating members disposed in contact with the corresponding developing agent bearing members, and the developing agent bearing members having an average surface roughness Rz that is smaller than an average particle size of the developing agent.

4. The color image forming device according to claim 1. wherein the layer thickness regulating units include the developing agent bearing members and a plurality of layer thickness regulating members disposed in contact with the corresponding developing agent bearing members, the layer thickness regulating members being formed from silicon rubber, the developing agent bearing members having an average surface roughness Rz in a range of 3 $\mu$m through 5 $\mu$m, and the developing agent have an average toner particle size of 9 $\mu$m.

5. The color image forming device according to claim 1, wherein the electrostatic latent image bearing members are formed from amorphous silicon; and the developing agent is a nonmagnetic single component developing agent; and further comprising:

a plurality of biasing units that apply electrical potential between the electrostatic latent image bearing members and the developing agent bearing members for moving a residual developing agent remaining on the electrostatic latent image bearing members onto the developing agent bearing members after the transfer unit has transferred the visible images from the electrostatic latent image bearing members onto the intermediate recording medium.

6. The color image forming device according to claim 1, further comprising a plurality of cleaning rollers for collecting a residual developing agent from the corresponding electrostatic latent image bearing members and for releasing the collected residual developing agent back onto the electrostatic latent image bearing members, the residual developing agent remaining on the electrostatic latent image bearing members after the transfer unit has transferred the visible images from the electrostatic latent image bearing members onto the intermediate recording medium, wherein the electrostatic latent image bearing members moves in a moving direction;

the developing agent bearing members confront the corresponding electrostatic latent image bearing members at confronting positions;

the cleaning rollers are positioned downstream from the corresponding transferring positions and upstream from the corresponding confronting positions in the moving direction of the corresponding electrostatic latent image bearing members;

when the cleaning rollers confront an image area of the electrostatic latent image bearing members in which an image is formed, the cleaning rollers electrically retain the collected residual developing agent; and when the cleaning rollers confront a nonimage area of the electrostatic latent image bearing members in which no image is formed, the cleaning rollers electrically release the collected residual developing agent back onto the electrostatic latent image bearing members.

7. The color image forming device according to claim 6, wherein the developing agent bearing members and the electrostatic latent image bearing members rotate, and rotational peripheral speed of the developing agent bearing members is at least 1.4 times faster than rotational peripheral speed of the electrostatic latent image bearing members.

8. The color image forming device according to claim 1, further comprising:

a feeding unit that feeds a recording medium in a feeding direction, the recording medium having a first surface and a second surface opposite from the first surface;

a feeding direction changing unit provided downstream from the transfer unit in the feeding direction for changing the feeding direction;

a color image transfer unit that transfers the color image from the intermediate recording medium onto the recording medium so as to form the color image on the recording medium, wherein the feeding direction changing unit changes the feeding direction after the transfer unit has transferred the color image onto the first surface of the recording medium for forming a subsequent color image onto the second surface of the recording medium.

9. The color image forming device according to claim 8, wherein the developing agent bearing members and the electrostatic latent image bearing members are rotatably provided, and a rotational peripheral speed of the developing agent bearing members is at least 1.4 times faster than that of the electrostatic latent image bearing is members.

10. The color image forming device according to claim 1, further comprising a plurality of biasing units that apply electrical potential between the electrostatic latent image bearing members and the corresponding developing agent bearing members for moving a residual developing agent remaining on the electrostatic latent image bearing members after the transfer unit has transferred the visible images onto the intermediate recording medium onto the developing agent bearing members, and the charging unit electrically charge the residual toner before the residual developing agent is moved from onto the developing agent bearing members.

11. The color image forming device according to claim 10, wherein the electrostatic latent image bearing members rotate at a peripheral rotational speed, and the intermediate recording medium is movable at a moving speed different from the rotational peripheral speed of the electrostatic latent image bearing members.

12. The color image forming device according to claim 10, wherein the charging units are disposed separated from the corresponding electrostatic latent image bearing members by a predetermined distance.

13. The color image forming device according to claim 12, the developing agent comprises positively charging developing agent.

14. The color image forming device according to claim 1, wherein the developing agent comprises a polymerized toner produced by suspension polymerization.

15. The color image forming device according to claim 1, further comprising a plurality of layer thickness regulating members each having a portion in contact with corresponding developing agent bearing member for slidingly frictionally contacting the developing agent, at least the portion of the layer thickness regulating member being formed from a member whose main component Is silicon rubber.

16. The color image forming device according to claim 1, wherein the developing agent is added with one of charge control agent added with quaternary ammonium salt and charge control agent provided with quaternary ammonium salt as a side chain.

17. The color image forming device according to claim 1, wherein the developing agent bearing members and the electrostatic latent image bearing members are rotatably provided, and rotational peripheral speed of the developing agent bearing members is at least 1.4 times faster than that of the electrostatic latent image bearing members.

18. A color image forming device comprising:

a plurality of electrostatic latent image bearing members aligned in a predetermined direction, each having a surface;

a plurality of charging units disposed separated from the corresponding electrostatic latent image bearing members, the charging units uniformly charging the surface of the electrostatic latent image bearing members;

a plurality of exposing units that selectively emit a light onto the surface of the corresponding electrostatic latent image bearing members which has been univormly charged by the charging units, thereby forming electrostatic latent images on the electrostatic latent image bearing members;

a plurality of developing agent bearing members disposed in confrontation with the corresponding electrostatic latent image bearing members, the developing agent bearing members bearing developing agent of different color;

a plurality of layer regulating units for regulating a thickness of a layer of developing agent on the corresponding developing agent bearing members into a two-layer thickness or less, wherein each layer of developing agent contacts at least one of the developing agent bearing member or a developing agent thickness regulation blade, thereby charging each layer of developing agent;

an intermediate recording medium movable in the predetermined direction, wherein the developing agent bearing members selectively supply the developing agent onto the corresponding electrostatic latent image bearing members, thereby developing visible images corresponding to the electrostatic latent images on the electrostatic latent image bearing members;

a plurality of transfer units that transfer the visible images from the electrostatic latent image bearing members onto the intermediate recording medium at transferring positions thereby forming a color image on the intermediate recording medium;

a plurality of cleaning rollers for collecting a residual developing agent from the corresponding electrostatic latent image bearing members and for releasing the collected residual developing agent back onto the electrostatic latent image bearing members after the transfer unit has transferred the visible images from the electrostatic latent image bearing members onto the intermediate recording medium, wherein the electrostatic latent image bearing members moves in a moving direction;

the developing agent bearing members confront the corresponding electrostatic latent image bearing members at confronting positions; and the cleaning rollers are positioned downstream from the corresponding transferring positions and upstream from the corresponding confronting positions in the moving direction of the corresponding electrostatic latent image bearing members.

* * * * *